US005207894A

United States Patent [19]

Presnall et al.

[11] Patent Number: 5,207,894

[45] Date of Patent: * May 4, 1993

[54] REMOVAL OF AROMATIC COLOR BODIES FROM AROMATIC HYDROCARBON STREAMS

[75] Inventors: Stewart H. Presnall; Robert J. Haynal; Beverly B. Slimp, Jr., all of Houston; Martin P. Grosboll, Kingwood; Pamela A. Yanchik, Houston, all of Tex.

[73] Assignee: Lyondell Petrochemical Company, Houston, Tex.

[ * ] Notice: The portion of the term of this patent subsequent to Jan. 14, 2009 has been disclaimed.

[21] Appl. No.: 775,339

[22] Filed: Oct. 11, 1991

Related U.S. Application Data

[63] Continuation-in-part of Ser. No. 596,478, Oct. 12, 1990, Pat. No. 5,081,325, and a continuation-in-part of Ser. No. 596,870, Oct. 12, 1990, abandoned.

[51] Int. Cl.[5] ..... C01G 25/00

[52] U.S. Cl. ..... 208/299; 208/310 R; 585/820; 585/823

[58] Field of Search ..... 208/299, 310 R; 585/823

[56] References Cited

U.S. PATENT DOCUMENTS

| | | | |
|---|---|---|---|
| 3,864,412 | 2/1975 | Murphy | 585/824 |
| 4,024,026 | 5/1977 | Gewartowski | 203/2 |
| 4,229,612 | 10/1980 | Hall, Jr. et al. | 585/823 |
| 4,243,831 | 1/1981 | Malloy et al. | 585/824 |
| 4,795,545 | 1/1989 | Schmidt | 208/91 |
| 4,827,077 | 5/1989 | Zinnen | 585/820 |
| 4,923,961 | 5/1990 | Vitands et al. | 528/482 |
| 5,081,325 | 1/1992 | Haynal et al. | 585/820 |

FOREIGN PATENT DOCUMENTS

| | | |
|---|---|---|
| 0209424 | 1/1987 | European Pat. Off. . |
| 0374320 | 6/1990 | European Pat. Off. . |

OTHER PUBLICATIONS

Kirk–Othmer, Encyclopedia of Chemical Technology, 1:563 (1978).

*Primary Examiner*—Theodore Morris
*Assistant Examiner*—Walter D. Griffin
*Attorney, Agent, or Firm*—Arnold, White & Durkee

[57] ABSTRACT

This invention provides a process to remove aromatic color bodies, particularly oxygen or sulfur containing aromatics from a $C_{8-11}$ aromatic hydrocarbon stream having a boiling range between about 160°–460° F. The process involves contacting the hydrocarbon stream with a neutral attapulgite clay for a time sufficient to adsorb the aromatic color bodies. The process is effective in reducing the APHA color value of the subject hydrocarbon stream from an initial 850–1100 value to about 400 or less.

7 Claims, 1 Drawing Sheet

REMOVAL OF AROMATIC COLOR BODIES FROM AROMATIC HYDROCARBON STREAMS

BACKGROUND OF THE INVENTION

This is a continuation-in-part application of pending applications Ser. Nos. 596,870, now abandoned, and 596,478, U.S. Pat. No. 5,081,325 both of which were filed Oct. 12, 1990.

This invention relates to a process for removing oxygenated aromatic compounds from aromatic hydrocarbon streams.

Crude petroleum oil is generally separated into various fractions having a specified boiling range and molecular weight. Each fraction is a complex mixture of compounds related generally by molecular weight and chemical class. One such hydrocarbon stream of interest here is derived from the cracking of petroleum or coal and subsequent distillation fractionation into boiling point ranges. The distillate having a boiling range between 160°–460° F. (70°–240° C.) is in major part composed of $C_{8-11}$ aromatics, such as unsubstituted or alkyl substituted styrenes, indenes, benzenes and indanes (such streams hereinafter are called resin oils or aromatic hydrocarbon streams).

In the bulk processing of crude oils to resin oils, there is generally unavoidable inclusion of aromatic color bodies. The color bodies which generally contaminate resin oils also exhibit a molecular weight similar to the desired components in resin oil and a boiling point within the specified 160°–460° F. range. These color bodies can be $C_{8-11}$ oxygenated aromatics such as, for example, unsubstituted or alkyl substituted phenols and quinones including, without limitation, phenols, cresols, catechols, resorcinols, hydroquinones, naphthoquinones, and naphthols; or sulfur containing aromatics, including but not limited to thiol, thiophene, and mercaptan structures. Because these aromatic color bodies are so similar in physical properties to the desired resin oil components, these color bodies were considered difficult to remove from the resin stream by typical adsorptive processes.

Resin oils are used in a wide variety of applications, for example, as a feedstock to manufacture hydrocarbon resins which are used in printing inks, adhesives, and rubber. Important characteristics sought in commercial preparations of resin oil streams are purity and lack of color. Thus, manufacturers of resin oil streams are under pressure to rid their commercial hydrocarbon products of contaminants which either directly or indirectly affect the purity or color of the products. Sulfur containing compounds can cause the hydrocarbon stream to have a variety of characteristics, such as color forming bodies or an unpleasant odor and, because sulfur is reactive, sulfur containing compounds can poison and/or consume catalysts used in subsequent reactions to which the resin oil may be subjected. Consumers of hydrocarbon resin oil products prefer a hydrocarbon feedstock stream having a sulfur content of less than 100 ppm because at this level, the resin produced from this hydrocarbon stream can be hydrotreated to yield an essentially clear product.

Various methods of purifying resin oil streams have been tried in the past; however, there is a need for a less expensive, commercially feasible method for purifying hydrocarbon streams.

SUMMARY OF THE INVENTION

It has been discovered that hydrocarbon resin oil streams can be purified of contaminating aromatic color bodies by contacting the resin oil stream with a "neutral" attapulgite clay adsorbent. The present invention is most effective when the hydrocarbon resin oil stream is first contacted with a molecular sieve.

DETAILED DESCRIPTION OF THE INVENTION

Figure 1A:
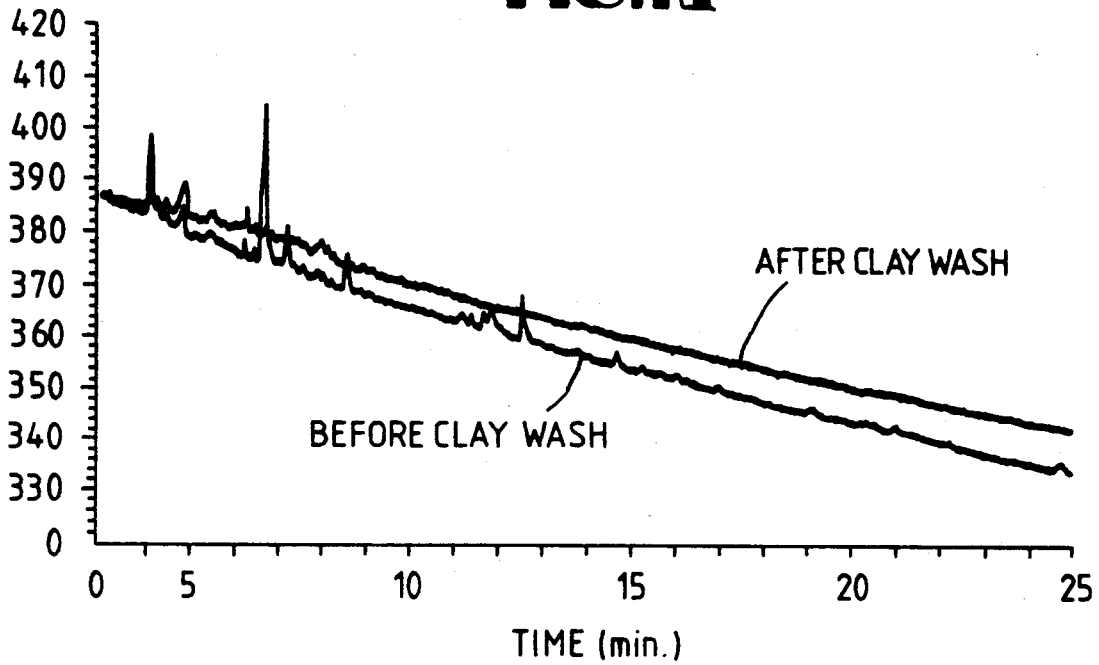
FIGS. 1*a* and 1*b* are gas chromatographs comparing the oxygenated aromatic color body content of a resin oil stream before and after treatment with neutral attapulgite clay.

For purposes of simplicity, the removal of aromatic color bodies from a hydrocarbon resin oil stream according to the present invention will be referred to as "purifying" or "purification" of the resin oil, and a stream that has been treated using the present invention will be referred to as a "purified" resin oil. The color purity of a hydrocarbon resin oil stream treated according to the present invention can be measured using the American Public Health Association ("APHA") system. See 1984 *Am. Soc. of Testing Materials* Vol. 06.01, p. 146, D 1209-84, Standard test method for color of clear liquids (platinum-cobalt scale), incorporated herein by reference. Alternatively, the purity of the treated hydrocarbon resin oil stream can be assayed by gas chromatography methods, well known in the art.

The resin oil streams which are the subject of the purification processes of the present invention comprise about 60% by weight or greater of $C_{8-11}$ aromatics, and preferably 85% or more $C_{8-11}$ aromatics. In general, the $C_{8-11}$ aromatic fraction is composed of about 60–70% by weight of unsubstituted or alkyl substituted aromatic olefins such as styrenes and indenes and 30–40% by weight of alkyl substituted aromatics such as alkyl benzenes and indanes. The balance of the resin oil is typically $C_{8-11}$ paraffins.

A hydrocarbon resin oil stream taken directly from a steam cracking olefins unit generally has an APHA number of about 850–1100. A treatment according to the present invention is considered successful if the APHA number is reduced to about 400 or less. The lower the APHA number of the treated hydrocarbon stream, the more successful the treatment. Another goal of treatment is that the percent of useful desired components left in the hydrocarbon stream should not be reduced significantly, for example, by no more than 10%.

The preferred adsorbent for use in the invention is neutral attapulgite clay. Attapulgite is a hydrated magnesium aluminum silicate mineral consisting of acicular-shaped particles with a mean particle size of about 0.1 micron existing naturally in aggregate form. Attapulgite is not a swelling clay. Domestic deposits are located chiefly in the Georgia-Florida region.

Acidic clays, especially acid treated clays that have not been neutralized in some manner, are not believed to be useful in the present invention because they tend to polymerize styrenic and other olefinic molecules, and the polymerized molecules then clog the pores of the clay and interfere with the purification process. In addition, such acid treated clays have been observed to generate exothermic reactions which interfere with the functioning of the invention.

Surprisingly, other common adsorbent and filtering media are substantially less effective in removing the color bodies from the subject resin streams. Such adsorbents include activated charcoal, ion exchange resins, various zeolites, molecular sieves, silica gel and the like.

An attapulgite clay is believed to be useful in this invention if, when 5 gm of clay is mixed with 10 gm of distilled water and shaken, the pH of the resulting mixture is between 5–9, particularly between 6–8, and most particularly 7. Such clays hereinafter will be called "neutral" attapulgite clays.

Usable clays have a mesh between approximately 4–300, preferably between 30–60. Those of skill in the art will recognize that, as the mesh of the clay increases, a higher pressure is required to pass the resin oil through the clay. Clays useful in the invention can be obtained from a number of sources, such as Oil Dri Corporation of America, 520 North Michigan Avenue, Chicago, Ill. 60611. Heating of the clay before use, e.g. by kilning, can be helpful to remove unwanted moisture; however, the clay should not be heated above 800° C, or the clay particles may fuse and clog, rendering the clay ineffective to clarify the hydrocarbon stream.

Purification of hydrocarbon streams according to the present invention has been found to be most effective when the hydrocarbon stream first is contacted briefly with a molecular sieve, particularly a 13× molecular sieve composed of alumina silicate. Such molecular sieves can be obtained from Davison Chemical, a Division of Grace Chemical, Baltimore, Md. 21203. Other molecular sieves, such as 4A and 5A molecular sieves are preferred to remove water and then preferentially a 13× molecular sieve can be used to remove water and color bodies conjunctively. Contacting the stream with a series of molecular sieves of increasing mesh size also may be an effective mode of practicing the invention.

Molecular sieves are used to remove water from the hydrocarbon stream. Water may block the active sites in the adsorbent which are responsible for purification of the stream. Certain molecular sieves, such as a 13× sieve obtained from Davison, also can remove color bodies according to the present invention; however, such molecular sieves are less effective and much more expensive than other adsorbents that are useful in the invention. Thus, such molecular sieves are not as efficient or economically desirable on a large scale as are other, less expensive adsorbents.

Adsorbents used to purify hydrocarbon streams according to the present invention have been found to be effective, without regeneration, up to approximately an 8:1 weight to weight ratio. For example, 100 gms of attapulgite clay is effective to clarify 800 gms of hydrocarbon stream. After this 8:1 ratio has been met, the clay is either disposed of or regenerated. Moreover, continuous agitation or slurrying of the clay with the resin oil enhances the contact time and thus results in a faster purification process.

The invention will be more clearly understood with reference to the following examples:

EXAMPLE 1

800 g of a hydrocarbon resin oil stream containing greater than 85% aromatic hydrocarbons and having an APHA number of approximately 950 were passed through a separatory funnel containing a 13× molecular sieve obtained from Davison Chemical, a Division of Grace Chemical, Baltimore, Md. 21203. The effluent from the separatory funnel was passed through a column containing 100 g of the materials listed on the following chart. After 45 minutes average residence time, the effluent was collected and the APHA numbers were measured using known methods. The following results were obtained:

| | Attapulgite Clay | Activated Alumina | Molecular Sieve (13×) | Molecular Sieve (3× 4×, 5×) |
|---|---|---|---|---|
| APHA | 340 | 800 | 490 | 950 |

The desirable hydrocarbon content of all samples was reduced by less than 10%.

The reagents used in the above experiments were obtained from the following sources: Ultra-Clear® attapulgite clay having a typical analysis of 65.98% $SiO_2$, 13.09% $Al_2O_3$, 5.32% MgO, 4.97% $Fe_2O_3$, 1.51% CaO, 1.21% $K_2O$, 0.78% $P_2O_5$, 0.23% $Na_2O$, 0.03% $SO_3$ and 4.64% LOI, and a mesh of 30/60 was obtained from Oil Dri Corporation of America, 520 North Michigan Avenue, Chicago, Ill. 60611; activated alumina having a mesh of 12/32 Was obtained from EM Science, a Division of EM Industries, Inc., an associate of E. Merck of Germany, Cherry Hill, N.J., 08034; and, molecular sieves were obtained from Davison Chemical, a Division of Grace Chemical, Baltimore, Md. 21203.

Two other materials also were tested for their clarification abilities—an acid treated clay and an amberlyst ion exchange resin. The results for these materials are not shown because the acid treated clay caught fire, and the amberlyst melted.

EXAMPLE 2

800 g of a resin oil containing greater than 85% aromatic hydrocarbons, having an APHA number of approximately 950 and containing 134 ppm of organically bound sulfur were passed through a separatory funnel containing a 13× molecular sieve obtained from Davison Chemical. The effluent from the separatory funnel was passed through a column containing 100 g of Oil Dri Ultra-Clear® attapulgite clay having a mesh of 30/60. After 45 minutes average residence time, the effluent was collected and the APHA number and sulfur content was measured using known methods. The APHA number of the treated resin oil was 220, and the sulfur content was reduced to 94 ppm.

EXAMPLE 3

750 g of a resin oil containing greater than 85% $C_{8-11}$ aromatic hydrocarbons were passed over a column packed with 100 g Oil Dri Ultra-Clear® 30/60 attapulgite clay. The initial APHA reading of the resin oil was 864. After a residence time of 30 minutes, an initial effluent was collected and tested. The resin oil after treatment had a APHA reading of 100.

Figure 1B:
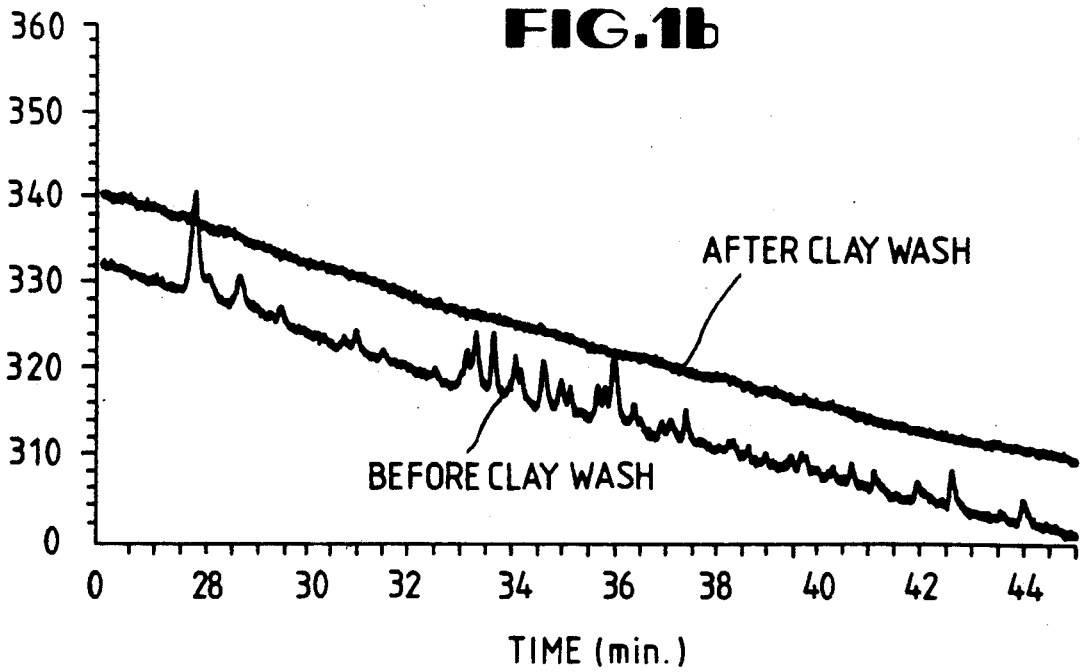

Further, the oxygenate content of the resin oil before and after clay treatment was measured on a Hewlett Packard gas chromatograph. FIGS. 1*a* and 1*b* show the comparison of oxygenate content before and after clay treatment of the resin oil. The top chromatograph on each of FIGS. 1*a* and 1*b* is a representation of the relative oxygenate content of the resin oil after clay treatment; and the bottom chromatograph is representative of the resin oil before treatment.

EXAMPLE 4

100 g of resin oil containing greater than 85% by weight $C_{8-11}$ aromatic hydrocarbons were admixed with 10 g of Oil Dri Ultra-Clear ® 30/60 attapulgite clay and continuously shaken. The initial APHA reading of the untreated resin oil was 1020. After two minutes of shaking, a sample of resin oil was tested and the APHA reading was 440. After a total of 7½ minutes of shaking, the treated resin oil was tested and had an APHA reading of 76.

A simple gravity driven or pump driven system or ebullient bed can be used in conjunction with a batch or continuous fixed bed or ebulliating bed to contact the resin oil through the adsorbent. The resulting purified stream can be collected by any known method, including, for example, collection in a pipeline so that the resulting stream can be transferred to another location.

While the invention has been described with respect to various specific examples and embodiments, it is to be understood that the invention is not limited thereto. Many variations and modifications may be made upon the specific examples disclosed herein, and the appended claims are intended to cover all of these variations and modifications.

What is claimed is:

1. A process for removing aromatic color bodies from a hydrocarbon resin oil stream comprising 60% or more of $C_{8-11}$ aromatics and having a boiling range between 160°–460° F. comprising the steps of contacting said hydrocarbon resin oil stream with an adsorbent consisting essentially of a neutral attapulgite clay for a time sufficient to purify said hydrocarbon resin oil stream, and collecting a purified resin oil.

2. A process for removing oxygenated aromatics from a hydrocarbon resin oil stream comprising 60% or more of $C_{8-11}$ aromatics and having a boiling range between 160°–460° F. comprising the steps of contacting said hydrocarbon resin oil stream with an adsorbent consisting essentially of a neutral attapulgite clay for a time sufficient to purify said hydrocarbon resin oil stream, and collecting a purified resin oil.

3. A process for reducing the APHA reading of a hydrocarbon resin oil stream comprising 60% or more of $C_{8-11}$ aromatics and having a boiling range between 160°–460° F. comprising the steps of contacting said hydrocarbon resin oil stream with an adsorbent consisting essentially of a neutral attapulgite clay for a time sufficient to reduce the APHA reading of said hydrocarbon resin oil stream to about 400 or less, and collecting said purified resin oil.

4. The process of claims 1, 2 or 3 wherein the resin oil comprises 85% or more of $C_{8-11}$ aromatics.

5. The process of claim 4 wherein the $C_{8-11}$ aromatics comprise a mixture of alkyl substituted benzenes, indanes, styrenes and indenes.

6. The process of claims 1, 2, or 3 wherein said hydrocarbons resin oil stream is first contacted with a molecular sieve.

7. The process of claim 6 wherein aid molecular sieve is 4A, 5A or 13×.

* * * * *